United States Patent [19]

Blackmore et al.

[11] Patent Number: 4,633,776

[45] Date of Patent: Jan. 6, 1987

[54] BRANCH COMPACTOR

[76] Inventors: William Blackmore, 24135 Mariposa Rd., Escalon, Calif. 95420; Vito Bavaro, 1641 Walnut St., Escalon, Calif. 95320

[21] Appl. No.: 616,846

[22] Filed: Jul. 10, 1984

[51] Int. Cl.[4] ..... B30B 3/04

[52] U.S. Cl. ..... 100/158 R; 56/14.3; 100/3; 100/159; 100/176

[58] Field of Search ..... 100/158 R, 144, 159, 100/173, 176, 2, 3, 6, 152, 153; 56/14.3, 94

[56] References Cited

U.S. PATENT DOCUMENTS

| | | | |
|---|---|---|---|
| 3,504,621 | 4/1970 | Qualheim | 100/176 |
| 3,792,655 | 2/1974 | Caddell et al. | 100/158 R |
| 4,010,680 | 3/1977 | Buck, Jr. et al. | 100/153 X |
| 4,399,745 | 8/1983 | Jorgensen et al. | 100/2 |

OTHER PUBLICATIONS

Forestry Processing Equipment, (1983), by Morbark, pp. 15, 16, 20, 120.

*Primary Examiner*—Timothy F. Simone
*Attorney, Agent, or Firm*—Bielen & Peterson

[57] ABSTRACT

A branch compactor for compacting branches, brush, small trees, and the like into a continuous bundle for compact disposal or input into a chipper device. The compactor includes a receiving bin and a coupled compactor mechanism, the bin has a bed conveyor for advancing loose branch material received in the bin toward the compactor mechanism. The compactor mechanism includes a pair of vertical entry rolls and a pair of horizontal secondary rolls arranged behind the entry rolls to define a constricted opening through which the branch material is drawn by projecting vanes on the contrarotated rolls.

13 Claims, 3 Drawing Figures

BRANCH COMPACTOR

BACKGROUND OF THE INVENTION

This invention relates to a branch compactor for compressing and compacting limbs, branches and shoots from pruning operations as well as whole small trees for convenient disposal or for efficient feed into a wood chipper or shredder.

In modern forest management environmental thinning of diseased, deformed, dead or simply overcrowded trees has enabled healthy, select trees to mature to maximum potential. Special efficient equipment has been developed to harvest, remove and chip the culled waste wood. Wood chips have a variety of uses, such as animal and plant bedding or fuel for energy systems.

The most efficient chipping systems are designed to chip whole trees having trunk diameters ranging from inches, up to several feet. Chipping machines are designed to accept the trees stem first and in some systems utilize a series of cushioned, toothed feed rollers to draw the stock into contact with the chipper blades. In such systems opposed feed rollers part and come together in accordance to the resistence change as individual or bunched trunks diminish to their stem and branch tips. Because of the great inconsistency in such feed stock, the feed rate is controlled by the natural or most effective chipping rate of the chipping blades. The feed rate thus accelerates as the dense trunks of the trees diminish to the divergent branches which are collapsed and contained by the pressure of the feed rollers. Frequently, as the branches are consumed, the chipper is operating far below its most effective and efficient capacity. Attempting to use conventional high capacity chippers for brush or pruning stock is even more inefficient and difficult, rarely approaching the chip rates for which the chippers are designed.

Chipping brush and branches in a foresty operation is usually ancillary to a high volume whole tree chipping operation, and is largely confined to cleanup. In some operations the unwieldy material may comprise the sole or principal feedstock. For example, in commercial fruit orchards huge volumes of pruning are generated annually. Conventional chippers are not equipped to handle such material economically. Conventional disposal by open burning of piled cuttings is no longer tolerated in many areas because of the attendant air pollution.

The branch compactor of this invention solves the problem in the economics of disposing of brush and branch like material by compacting such material into a tight bundle which can be conveniently fed into a conventional wood chipper, allowing the chipper to operate at an optimum capacity.

Where the material is to be transported elsewhere for disposal, the continuously extruded bundle can be bound and periodically cut for stack loading in a disposal vehicle with great savings in space.

SUMMARY OF THE INVENTION

The branch compactor of this invention comprises a portable field unit designed to compress loose, unwieldy, branch material to a compact bundle. For example, orchard pruning, having a density of approximately one and one-half pound per cubic foot are compressed to a continuous bundle having a density over fifteen pounds per cubic foot. The bundle produced can be sectioned and stacked for disposal, or can be fed directly to a wood chipper, where the waste material can be converted to a material of economic value. The mechanics of the unit perform the compressing and compacting in a manner that minimizes breakage and substantially aligns the cutting stems to the optimim advantage for efficient chipping.

Central to the units operation is a compacting mechanism comprising a pair of opposed, vertical entry rolls and pair of opposed horizontal secondary rolls positioned behind the entry rolls. The rolls in each pair are parallel and displaced approximately one foot apart to define a square opening approximately one foot square. While the precise size of the opening is not critical, it has been found that the preferred size can easily accept branches with butt ends up to 3inches in diameter and produce a compact bundle of pruning at a rate of 60 feet/minute, representing over twenty tons per hour. This rate is adequate to optimize all but the largest chippers. The compactor can easily be enlarged in size for increased capacity, by enlarging the space between opposed rolls and/or accelerating the feed.

The rolls are connected to bearing which are rigidly mounted to a frame structure designed to withstand the forces of compression. A wide flaring couples the compacting mechanism to an elongated feed bin with a flat bottom with a chain-link conveyer rake and a pair of of upwardly flared sides which aid in orienting the prunings when dumped into the bin. For a maximum feed rate, the preferred embodiment is equipped with a pair of elongated feed rolls positioned along the flared sides. The elongated feed rolls when properly rotated drive the loose cuttings down against the chain-link conveyer rake. The conveyer rake urges the material into the vertical compression rolls, which in cooperation with the horizontal compression rolls compress the loose cuttings into a tight bundle.

These and other features of the preferred embodiment are shown in the drawings and described in greater detail in the Detailed Description of the Preferred Embodiment.

DESCRIPTION OF THE PREFERRED EMBODIMENT

Figure 1:
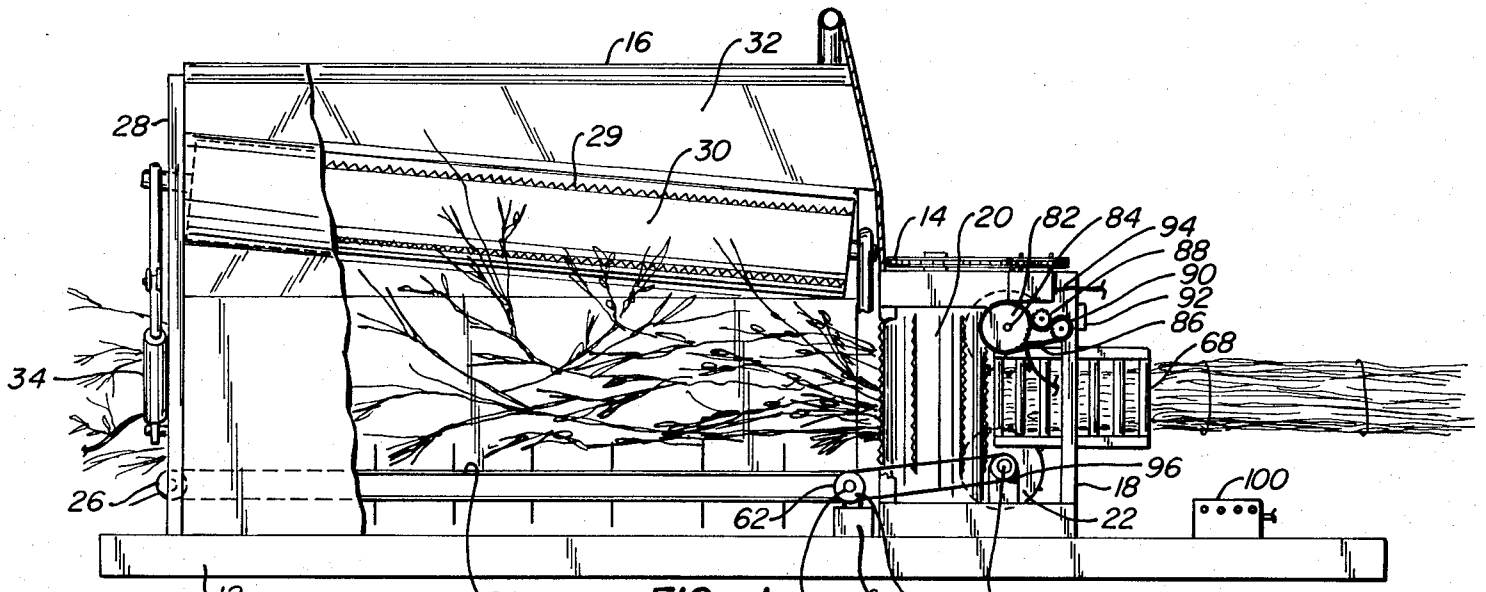
FIG. 1 is a side elevational view of the branch compactor partially fragmented to illustrate the inside of the feed bin.

Referring to FIG. 1, the branch compactor 10 is shown as a unit having a structural frame with two parallel bottom frame beams 12 supporting a compacting mechanism 14 and a feed bin 16. The frame beams 12 provide a skid mount for the unit and can be used for coupling a wheeled undercarriage or bogie for complete portability.

The compacting mechanism 14 includes a structural box frame 18 mounted to the underlying frame beams 12. The box frame 18 supports the elongated vertical rolls 20 and short horizontal rolls 22, which comprise the heart of the compacting mechanism 14.

Figure 2:
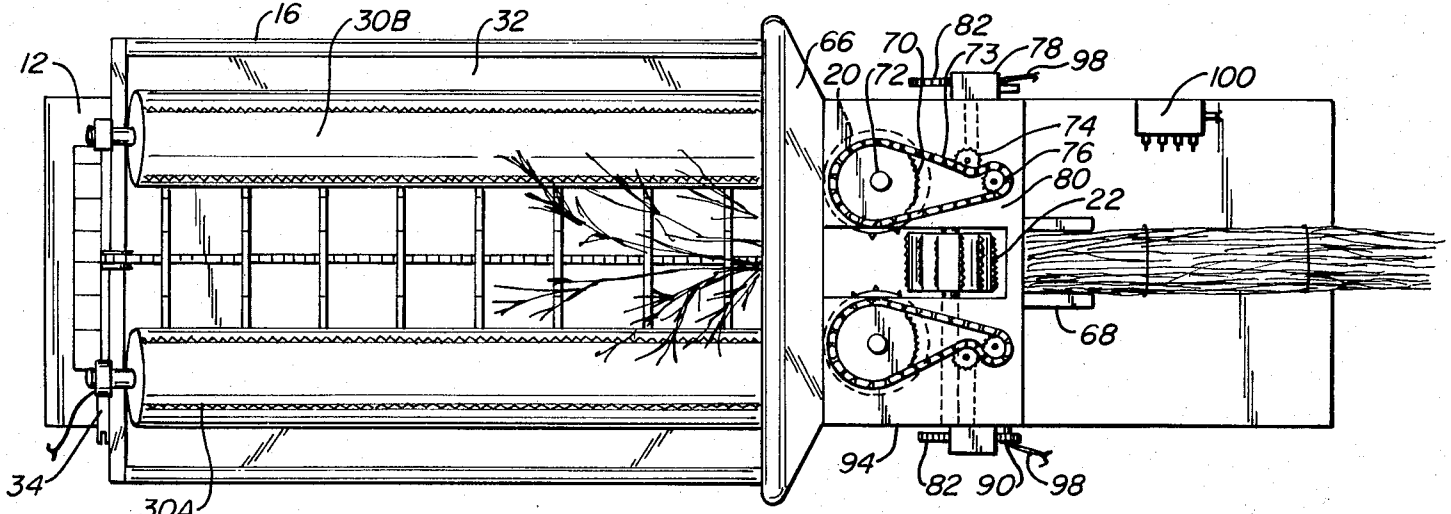
FIG. 2 is a top view of the branch compactor of FIG. 1.
Figure 3:
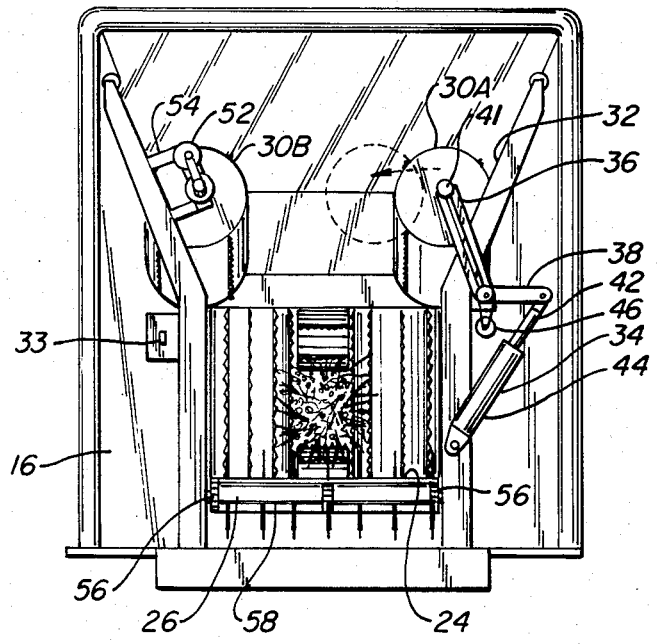
FIG. 3 is an end view of the branch compactor of FIG. 1.

The feed bin 16 is constructed with a flat central bed 24 as shown in FIGS. 2 and 3 that includes a conveyer rake mechanism 26, which sweeps from an open end 28 toward the compacting mechanism 14. Branch or stem cuttings, collectively cuttings, are deposited into the bin 16 and are downwardly urged by projecting saw-tooth vanes 29 on a pair of rotating elongated feed rolls 30, which are located along the upper flared portion 32 of the bin 16. The feed rolls 30 are oriented off-horizontal, sloped downwardly toward the compacting mechanism 14. This orientation biases the feeding of the deposited cuttings in the direction of the movement of the underlying rake mechanism 26.

One of the feed rolls 30A, is mounted to an actuator mechanism 34, which moves the feed roll away from the upper flared portion 32 of the bin 16 toward the center of the bin, when there is a slack in the rate of deposit of cutting into the bin. This insures a reasonably steady feeding and may be operated by an activating switch 33. The actuator mechanism 34 includes a support arm 36 and crank lever 38 pivotally mounted to a pivot bracket 40 at each end of the feed roll 30A. The support arms 36 connect to the end journals 41 of the feed roll 30A and the crank lever 38 connects to piston arm 42 of an air ram 44 which when activated urges the feed roll toward the center of the bin. A hydraulic drive motor 46 mounted to the crank lever 38 has a chain sprocket 48 that drives a chain which engages a sprocket 50 on the journal of the roll to rotate the roll during operation. A similar drive motor 52 mounted to the fixed journal support bracket 54 of the other stationary feed roll 30B rotates the roll in contrarotation with the articulated roll.

The rake mechanism 26 utilizes a pair of endless link chains 56 which are interconnected by a series of sweeper rakes 58 which span the bed 24 and are transported toward the compacting mechanism by the coupled drive of the two link chains 56. The link chains are driven from a sprocket 58 on an axle extension 60 from the lower horizontal compacting roll 22A, which engages a sprocket 62 on the chain link axel 64.

Returning to a consideration of the compacting mechanism, the two vertical rolls 20 are positioned at the conflux of a shroud 66 to funnel the cuttings toward the rolls 20. The rolls have saw-tooth vanes 67 to forceably urge the oncoming cuttings into the vertical space between the paired rolls where the cuttings are bunched together. Immediately after the vertical rolls 20 are positioned the horizontal rolls 22. The horizontal rolls 22 force the vertically extended cuttings into the space between the horizontal rolls 22. The resulting compaction of the cuttings to approximately a one foot square extrusion is preserved by a roller fence 68. The compacting cuttings are expelled in a continuous bundle for disposal ideally by coodinated feed directly into a chipper machine.

Referring to the top view of FIG. 2 the vertical rolls 20 each have a driven sprocket 70 mounted to the roller axle 72, with a chain 73 linking a tension sprocket 74 and drive sprocket 76 of a hydraulic motor 78 mounted to the underside of a mounting plate 80, fixed to structural box frame 18. The axles 72 of the vertical rolls are mounted in suitable bearings blocked to the box frame 18.

In a similar manner, the horizontal rolls, as shown in FIG. 1 have a driven sprocket 82 mounted to an extended roller axle 84, with a chain 86 linking a tension sprocket 88 and drive sprocket 90 of a hydraulic motor 92 mounted to the frontside of a mounting plate 94. The axles 84 are mounted to bearings 96 blocked to the box frame 18.

The hydraulic lines 98 connected to each motor supply fluid from an external source to drive the rolls in each pair in a contrarotational manner. The lines 98 are collected at a junction box 100 to provide proper line spliting for main supply and return line 102 tapped to a hydraulic source pump (not shown) which may be mounted on the frame or on an auxilliary piece of operating equipment such as a tractor.

By proper regulation of the hydraulic supply, the rate of operation can be varied, for example, to comply with variations in the load rate during operations of a chipper.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A branch compactor comprising:

(a) a feed bin having a conveyor means for advancing branch-like material placed in said bin, and, (b) a compacting mechanism coupled to an end of said feed bin said compacting mechanism having a frame structure wherein is mounted:

(i) a pair of vertical rolls displaced a distance apart, said rolls having drive means for contrarotation; and (ii) a pair of horizontal rolls displaced a distance apart, said rolls having drive means for contrarotation; said vertical rolls and horizontal rolls juxtaposed to define a constricted substantially square opening wherein said rolls having surface vanes to draw material advanced from said conveyer means through said constricted opening for discharge in a compact continuous bundle, wherein said pair of vertical rolls comprise tall entry rolls to said compacting mechanism arranged at one end of said feed bin proximate said conveyer means and said pair of horizontal rolls comprise short secondary rolls arranged behind said entry rolls, said arrangement of rolls being fixed to maintain said defined opening, wherein material is transported from said conveyer means first to said entry rolls and then to said secondary rolls.

2. The branch compactor of claim 1 having a discharge guide means for guiding the branch bundle out from said compacting mechanism.

3. The branch compactor of claim 2 wherein said guide means comprises a pair of vertically oriented parallel roller fences mounted in said frame structure proximate said pair of horizontal rolls.

4. The branch compactor of claim 1 wherein said bin has an end shroud means mounted between said feed bin and said compacting mechanism to funnel said branch - like material toward said rolls.

5. The branch compactor of claim 1 wherein said conveyer means comprises a rake mechansim arranged at the bottom of said bin, said rake mechanism having a series of sweeper rakes connected to a link chain drive.

6. The branch compactor of claim 1 wherein said vertical and horizontal rolls have hydraulic drive motors operationally connected thereto for rotating said vertical and horizontal rolls.

7. The branch compactor of claim 6 wherein said drive motors have associated control means for regulating the operational speed of compacting.

8. The branch compactor of claim 1 wherein said bin has a flat bottom bed, and side walls having an outwardly flared upper portion.

9. The branch compactor of claim 8 wherein said bin has an end opposite said compactor mechanism that is open.

10. A branch compactor comprising:

(a) a feed bin having a conveyer means for advancing branch-like material placed in said bin, and, (b) a compacting mechanism coupled to an end of said feed bin said compacting mechanism having a frame structure wherein is mounted:

(i) a pair of vertical rolls displaced a distance apart, said rolls having drive means for contrarotation; and (ii) a pair of horizontal rolls displaced a distance apart said rolls having drive means for contrarotation; said vertical rolls and horizontal rolls juxtaposed to define a constricted, substantially square opening wherein, said rolls have surface vanes to draw material advanced from said conveyer means through said constricted opening for discharge in a compact continuous bundle, wherein said bin includes side walls having pair of spatially displaced, elongated feed rolls with projecting surface vanes and means for supporting said feed rolls adjacent said side walls.

11. The branch compactor of claim 10 wherein said means for supporting said feed rolls includes drive means for rotating said feed rolls in a contrarotational manner for urging branch-like material downward between said rolls.

12. The branch compactor of claim 11 wherein said means for supporting at least one of said feed rolls includes a displacement mechanism for displacing said roll toward the other of said rolls.

13. The branch compactor of claim 11 wherein said feed rolls are arranged against said side walls in a downward sloping angle toward said compacting mechanism.

* * * * *